United States Patent [19]

Karlstrom et al.

[11] Patent Number: 4,529,982

[45] Date of Patent: Jul. 16, 1985

[54] VEHICLE LOCATING SYSTEM

[75] Inventors: Krister Karlstrom, Stockholm; Rolf Fabricius-Hansen, Alvsjo, both of Sweden

[73] Assignee: Flintab AB, Västerås, Sweden

[21] Appl. No.: 384,614

[22] Filed: Jun. 3, 1982

[51] Int. Cl.[3] ..... G08G 1/12; G08G 1/01

[52] U.S. Cl. ..... 340/991; 340/941; 340/933; 340/989

[58] Field of Search ..... 340/23, 24, 32, 38 L, 340/941, 933, 989–992; 324/236; 246/122 R, 167 R

[56] References Cited

U.S. PATENT DOCUMENTS

| | | | |
|---|---|---|---|
| 3,419,865 | 5/1967 | Chisholm | 340/24 |
| 3,697,941 | 10/1972 | Christ | 340/23 |
| 3,757,290 | 9/1973 | Ross et al. | 340/23 |
| 3,868,626 | 2/1975 | Masher | 340/38 L |
| 4,083,003 | 4/1978 | Haemmig | 340/23 |
| 4,083,008 | 4/1978 | Eschke | 340/23 |
| 4,251,797 | 2/1981 | Bragas | 340/23 |
| 4,253,192 | 2/1981 | Donnally et al. | 455/98 |

OTHER PUBLICATIONS

*NEC Research and Development*, Mikami, No. 52, Jan. 1979, pp. 1–10.

*Primary Examiner*—James J. Groody
*Attorney, Agent, or Firm*—Yount & Tarolli

[57] ABSTRACT

Location-representative signals are communicated to vehicles (12, 14, 16) by modifying existing traffic detector stations of the type utilizing an inductive coil (20) embedded in the roadway (22). Circuitry (44–52) is provided for generating a carrier signal modulated in accordance with a modulating signal representative of the location of an associated traffic detector station. A transformer (56) couples the modulated carrier signal into the existing inductive coil such that the coil establishes a magnetic field above the roadway which is modulated by the location representative signals. The vehicles have inductive coils (70) mounted thereon for sensing the modulated magnetic fields, and circuitry (72, 74, 76) for extracting the location-representative signals therefrom. The location-representative signals may then be, e.g., automatically transmitted to a central dispatching station (18).

10 Claims, 4 Drawing Figures

VEHICLE LOCATING SYSTEM

BACKGROUND AND FIELD OF THE INVENTION

The present invention relates to a method and apparatus for automatically identifying the location of a vehicle.

Various systems are known in the art for automatically locating a plurality of fleet vehicles, such as taxi cabs, police cruisers, etc. over the relatively large area serviced by the fleet of vehicles. In a system described in the patent to Chisolm, U.S. Pat. No. 3,419,865, the location of each vehicle is determined by triangulating its location with distance information obtained by reception of its radio signal by plural spaced receivers. Other systems, however, include a plurality of wayside stations distributed throughout the service area, where each station automatically communicates a location-identifying signal to vehicles passing nearby. Each vehicle automatically retransmits the location-identifying signal to a central station. The central station then logs that vehicle as being at the identified location at that time.

One of the difficulties with the latter type of system resides in the cost and reliability of the short range communication links between each wayside station and nearby vehicles. Often, the wayside stations communicate the location-identifying signals to the passing vehicles by means of short range radio transmitters. Patents disclosing systems of this sort include Haemmig, U.S. Pat. No. 4,083,003 and Ross et al., U.S. Pat. No. 3,757,290. In another system, disclosed in Christ, U.S. Pat. No. 3,697,941, the location-identifying information is communicated to the vehicles by means of modulated light energy.

SUMMARY OF THE INVENTION

The present invention provides an inexpensive and reliable system for communicating location-identifying information to vehicles. In the system, information is communicated to the vehicles via existing inductive loops embedded in the roadway. Inductive loops such as this are widely used for the detection of traffic, either for statistical traffic pattern analysis or for control of one or more traffic lights in the vicinity.

In accordance with the present invention, means is provided for generating a carrier signal modulated with a location-identifying signal identifying the location of the corresponding one of the inductive loops. Means is also included which is adapted to add the modulated carrier signal to the signal which is normally being applied to the existing inductive loop embedded in the roadway. The inductive loop thereby creates a magnetic field above the roadway which is modulated in accordance with the location-identifying signal.

The vehicle whose location is to be monitored includes means for detecting and demodulating this modulated magnetic field whenever the vehicle is passing over the inductive loop. Usually, the vehicle will also include some means for transmitting the location-identifying signal thus detected and demodulated back to a central location.

BRIEF DESCRIPTION OF THE DRAWINGS

The foregoing and other objects and advantages of the present invention will become more readily apparent from the following detailed description, as taken in conjunction with the accompanying drawings, wherein.

DESCRIPTION OF PREFERRED EMBODIMENT

Figure 1:
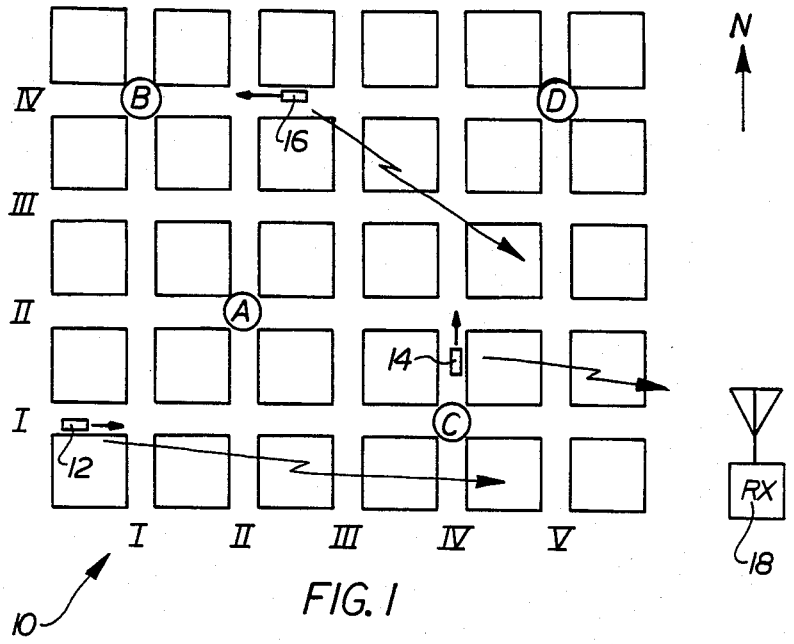
FIG. 1 is a street map useful in understanding the general aspects of the vehicle locating system in accordance with the present invention.

FIG. 1 is a map of a road system upon which a fleet of vehicles operates. In FIG. 1, the road system is shown as including four east-west roads I, II, III and IV and five north-south roads I, II, III, IV and V. In the FIG. 1 map, three fleet vehicles 12, 14 and 16 are travelling along the road system. A central station 18 keeps track of the location of the various fleet vehicles, and dispatches the vehicles on various errands as necessary.

In many systems the process of keeping track of the location of fleet vehicles is handled entirely manually. In these systems the vehicle operators are relied upon to periodically advise the central station 18 of their location by appropriate radio communications. In other systems, however, the process of communicating vehicle location information from the vehicles to the central station is accomplished automatically so as to relieve the motor vehicle operator of the burden of repeatedly communicating the vehicle location to the central station.

Automatic vehicle locating systems usually provide plural transmitting stations disposed at fixed locations in the area serviced by the vehicles. Each transmitter transmits a signal defining the location at which that transmitter is disposed. As the vehicle passes the transmitter, it receives the location information and retransmits it via a radio carried in the vehicle to a central location such as 18. In the map of FIG. 1, four such transmitter stations are represented at A, B, C and D.

As mentioned previously, the manner in which the location-identifying signal is transmitted to nearby vehicles from the various fixed stations differs from system to system. Each of the prior techniques has associated disadvantages, and it would be desirable if some other method could be provided for communicating the location-identifying coded signals to the vehicles.

In accordance with the present invention, the location-identifying signals are communicated to the vehicle by means of a modulated magnetic field, formed by modifying a conventional traffic detector station of the type including an inductive loop embedded in the roadway.

Figure 2:
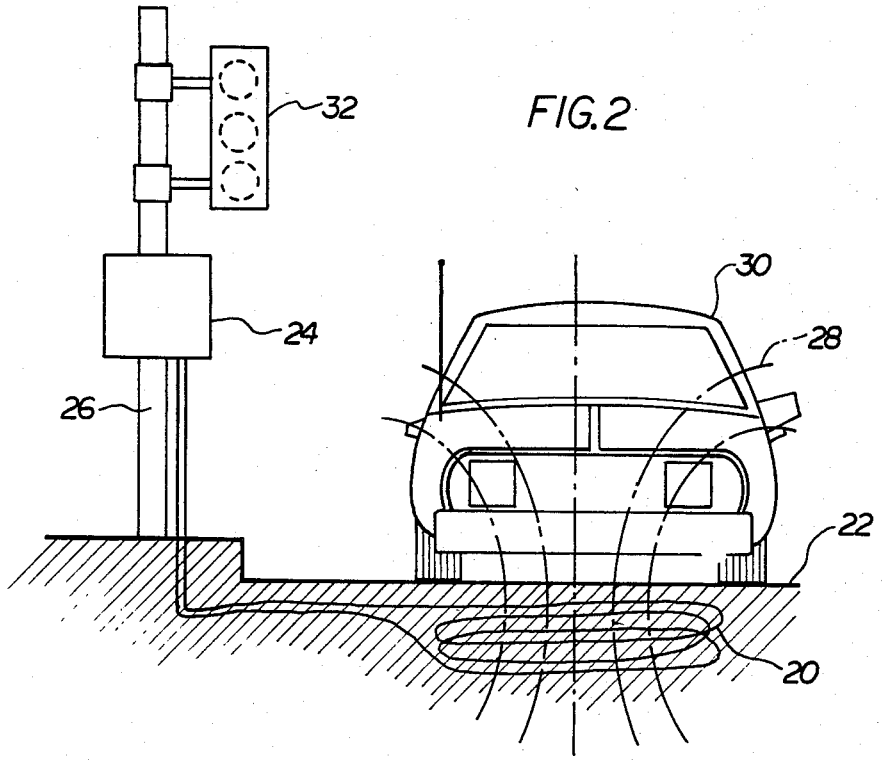
FIG. 2 is a schematic representation of the major features of a conventional traffic detection system using an inductive loop embedded in the roadway.

FIG. 2 is a schematic view of a street intersection, generally showing the elements of an inductive loop traffic detection system. As shown in FIG. 2, an inductive loop 20 is embedded in a roadway 22 below the portion of the roadway over which the vehicles are expected to pass. The two ends of the inductive loop 20 are coupled to respective inputs of a traffic detector circuit, located within a box 24 mounted on a support pole 26. The coil 20 represents part of a tuned oscillator operating at a frequency in the range of, for example, 100–400 kHz. U.S. Pat. No. 3,868,626 discloses one form which the traffic detector circuitry has taken in the past. The control circuit located within the box 24 energizes the inductive coil 20 such that a magnetic field is established above the roadway. The magnetic field is indicated in FIG. 2 by the dotted lines 28, which trace magnetic flux paths through the inductive coil 20.

When a vehicle 30 passes over the inductive loop 20, it has the effect of changing the magnetic permeability along the flux paths through the inductive coil 20, thereby influencing the oscillating electric signal which energizes the inductive coil. The circuitry located within the box 24 detects the shifts in the oscillations (either in their amplitude, frequency, or phase) caused by the change in magnetic permeability in the vicinity of coil 20, and then decides based upon these changes whether or not a vehicle has stopped above or passed over the inductive coil 20. This circuitry may include control elements for controlling an adjacent traffic light 32, or perhaps several traffic lights in the vicinity.

The inductive loop traffic detection apparatus shown in FIG. 2 can readily be modified so as to provide an inexpensive and reliable method of communicating location-identifying information to vehicles passing over the inductive loop. Generally, this is accomplished by modulating a carrier signal in accordance with a coded signal identifying the location at which the traffic detection circuitry is disposed, and by then adding the modulated carrier into the oscillating signal used to energize the inductive loop 20. The effect of this is to provide a modulated magnetic field component which can be detected by suitable receiving equipment on vehicles passing over the inductive loop.

Figure 3:
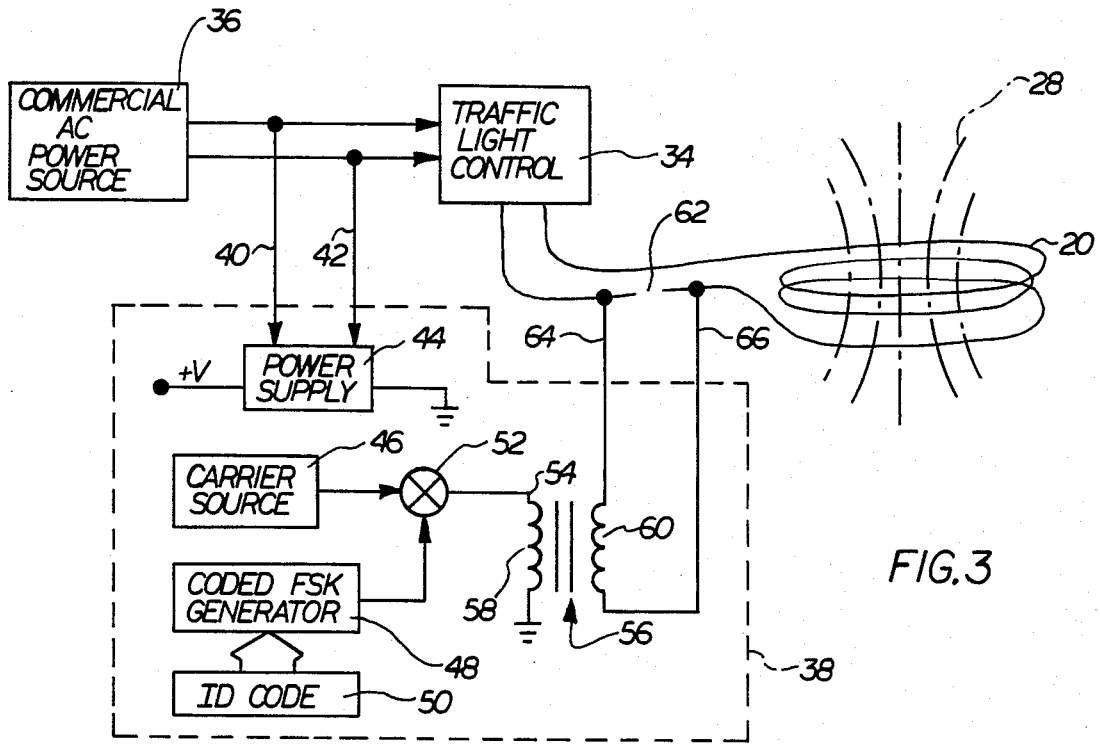
FIG. 3 is a block diagram of the location-identifying signal transmitter in accordance with the teachings of the present invention.

FIG. 3 illustrates the traffic detection circuitry of FIG. 2, modified in order to add the location-identifying information into the magnetic field established around the inductive loop 20. In FIG. 3, the inductive loop 20 is shown connected to the output of a traffic light control circuit 34, which may have any conventional form. Many types of traffic light control circuits are presently in use, and it is contemplated that the invention can be utilized in conjunction with any of these. The traffic light control circuit 34 is mounted within the box 24, which is conventionally large enough that additional space is available in it for mounting other components. The traffic light control circuit 34 will usually be powered from a conventional commercial AC power source 36.

In accordance with the present invention, an additional circuit 38 is added to the components described above. Preferably, the circuitry 38 will be housed within an enclosure suitable for mounting within the box 24 of FIG. 2. As shown in FIG. 3, the circuitry 38 has only four leads, whereby its connection into the existing circuitry is readily accomplished. Two of the lines 40 and 42 are used to connect the power source 36 to the power supply 44 which powers the circuitry 38. The power supply 44 includes suitable rectification and filtering components such that the AC signal appearing across the lines 40 and 42 is converted into one or more DC power supply signals for powering the remainder of the circuitry 38. For simplicity of illustration, the interconnections between the power supply 44 and the remainder of the circuitry 38 are not shown in FIG. 3.

The circuitry 38 also includes a carrier source 46 which provides a carrier signal upon which the location-identifying coded signal is to be modulated. This carrier source may, for example, provide an AC signal having a frequency of 29 kHz. The frequency of the carrier signal will be selected such that it does not interfere with the operation of the traffic light control circuit 34. In FIG. 3, the carrier signal provided by carrier source 46 is amplitude modulated by a frequency-shift-keyed (FSK) signal generated by a circuit 48. The FSK signal provided at the output of the generator 48 is modulated by a binary signal coded so as to contain information representative of the street location of the inductive loop 20 with which the circuitry 38 is intended to be associated. This identification (ID) code will preferably be provided by a code circuit 50 which can be readily adjusted or changed, such that the circuit 38 can be made to contain a selected one of many different ID codes. The ID code generator 50 may be a read-only memory (ROM) having the ID code stored therein, or may merely comprise a series of micro-switches, a number of jumper wires, etc. The ID code may represent a serial number, in which case the central station 18 will contain a chart or look-up table correlating the serial number with a particular street address. Preferably, however, the code will be an actual address, either street address or latitude/longitude, represented in ASCII code.

The output of the ID code circuit 50 is a multibit binary word representative of the location at which the circuitry 38 will be installed. The identifying code is provided in parallel to the coded FSK generator 48, which provides an FSK signal at its output serially modulated by the individual bits of the ID code provided by circuit 50. The FSK signal is continuously and repeatedly modulated by the ID code. Thus, each bit of the ID code controls the frequency of the output signal provided by FSK generator 48 in a corresponding periodic time slot. If the bit has a logic value of "1", then the output frequency will be, for example, 2100 Hz in the corresponding time slot. If, on the other hand, the logic value of that bit is "0", then the frequency of the signal in the corresponding time slot will be different, for example, 1300 Hz. The FSK signal will be modulated at, e.g., 1200 baud.

The FSK signal provided at the output of the FSK generator 48 is provided to an amplitude modulator circuit 52, which amplitude modulates the carrier signal provided by carrier source 46 in accordance with the FSK signal. The resulting modulated carrier signal is continuously provided along an output line 54 to a transformer 56.

The transformer 56 is used to couple the modulated carrier signal provided along the output line 54 into the inductive loop 20. The output signal provided along the output line 54 is applied across the primary winding 58 of the transformer 56, whereas the secondary winding 60 is connected in series with the inductive coil 20. The transformer 56 may be a standard 24/24 turn transformer. The interconnection of the secondary winding 60 of transformer 56 with the inductive coil 20 may be readily accomplished by breaking one of the leads to the inductive loop 20 (indicated at 62 in FIG. 3), and connecting each end 64 and 66 of the secondary winding 60 to a corresponding one of the resulting two leads.

The interconnection of the transformer 56 with the inductive loop 20 does not influence the operation of the traffic detection and control circuitry, since the modulated carrier signal provided along the output line 54 is selected to lie within a different frequency range than the oscillating signal used by the traffic light control circuit 34, and since the secondary winding 60 of the transformer 56 has a low impedance relative to other impedances within the circuit. Furthermore, the traffic control circuit 34 will automatically compensate for whatever impedance shift the secondary winding may introduce. Traffic control circuits are designed to be self-balancing in this respect so as to compensate for the effects which rainstorms, nearby parked cars, etc., have on the operation of the circuit.

The effect of coupling the transformer 56 into the circuit of the inductive loop 20 is to add the modulated carrier signal to the excitation signal normally being applied across the inductive loop 20. Thus, the magnetic field established about the inductive loop 20 then includes a modulated component at the frequency of the carrier source 46, where that component is modulated in accordance with the FSK signal carrying the location-identifying code.

Figure 4:
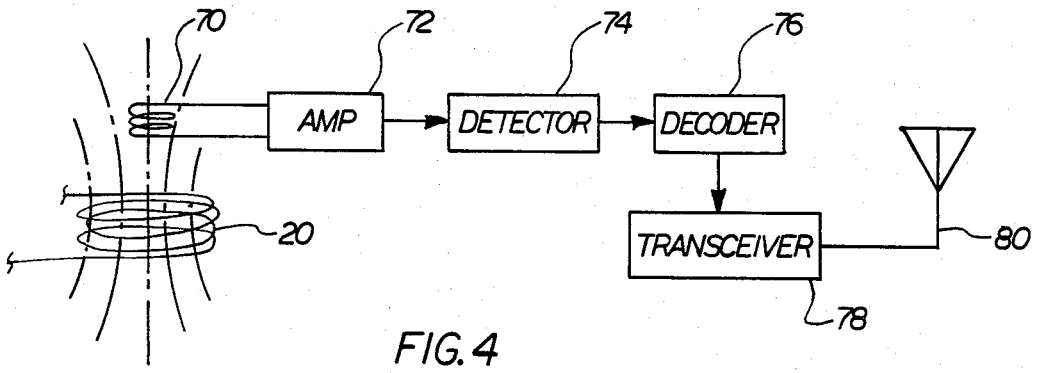
FIG. 4 is a block diagram of one embodiment of the receiving circuitry to be associated with the vehicle whose location is to be monitored.

The vehicles which participate in the location monitoring system include suitable apparatus for detecting the modulated magnetic fields established by the inductive loops 20 at the various traffic detection stations which have been modified as shown in FIG. 3. One embodiment of circuitry suitable for this purpose is shown in FIG. 4. As shown in FIG. 4, the circuitry to be associated with a participating vehicle includes an inductive loop 70 to be mounted on the under carriage of the vehicle in a generally horizontal orientation. When thus mounted, the axis of inductive loop 70 will be aligned parallel to the magnetic axis of the inductive coil 20 embedded in the roadway when the vehicle passes over the coil 20. The magnetic flux passing through the inductive coil 20 then also passes through the inductive coil 70 associated with the vehicle, whereby an electrical signal is induced across the coil which corresponds to the signal applied across the inductive loop 20.

The induced signal is amplified by a tuned amplifier 72 which has a frequency-dependent characteristic such that it selectively responds to the frequency component upon which the location-identifying information is modulated. This frequency component is provided to a detector and decoder circuit 74 which amplitude detects that frequency component so as to thereby derive an FSK signal corresponding to the FSK signal provided at the output of coded FSK generator 48 (FIG. 3). The FSK signal is applied to a decoder circuit 76, which recovers the ID code from the FSK signal. The resulting ID code corresponds to the ID code provided by circuit 50 of FIG. 3.

The ID code thus recovered is thereafter automatically transmitted to the central station 18 (FIG. 1) via a transceiver 78. The transceiver modulates an RF carrier signal in accordance with the location ID code and a vehicle ID code unique to that vehicle. The modulated RF carrier signal is applied to an antenna 80 for transmission to the central station 18. The circuitry for automatically communicating the location-identifying code to a central location 18 by means of a radio transmission is well known in the art, and will therefore not be described in detail herein.

Although the invention has been described with respect to a preferred embodiment, it will be appreciated that various rearrangements and alterations of parts may be made without departing from the spirit and scope of the present invention, as defined in the appended claims.

What is claimed is:

1. Apparatus for providing a location-identifying signal to a vehicle, comprising:

means for generating a carrier signal modulated in accordance with said location-identifying signal; and means adapted to add said modulated carrier signal to the signal normally being applied to an existing inductive coil embedded in a roadway for traffic detection purposes.

2. Apparatus as set forth in claim 1, wherein said means for generating a modulated carrier signal comprises first means for generating a frequency-shift-keyed signal modulated in accordance with said location-identifying signal, second means for providing a carrier signal, and third means for amplitude modulating said carrier signal in accordance with said frequency-shift-keyed signal so as to thereby provide said carrier signal modulated in accordance with said location-identifying signal.

3. Apparatus as set forth in claim 2, wherein said means adapted to add said modulated carrier signal to said signal normally being applied to an existing inductive coil comprises a transformer having first and second windings, said first winding being coupled to the output of said third means and said second winding being adapted to be connected in series with said existing inductive coil.

4. Apparatus as set forth in claim 1, wherein modulated carrier signal adder means comprises a transformer having a first winding coupled to the output of said modulated carrier signal generating means and a second winding adapted to be connected in series with said existing inductive coil.

5. Apparatus as set forth in claim 1, wherein said generating means includes means for providing a said modulated carrier signal having a frequency selected such that said apparatus does not interfere with the operation of said coil for traffic detection purposes.

6. A method of providing a location identification to a vehicle utilizing a pre-existing system which includes an inductive coil embedded in the roadway and a circuit for applying a first signal to said coil for purposes unrelated to providing location information to vehicles, said method comprising the steps of:

generating a signal representative of said location identification; and applying said location-identifying signal to said existing inductive coil originally embedded in a roadway for purposes other than communication of information to the vehicle, whereby said existing inductive coil creates a magnetic field above said roadway for interception by said vehicle, where the magnetic field includes not only a component produced by said first signal but also a component modulated with said location-identifying signal.

7. A method as set forth in claim 6 wherein said step of applying said location-identifying signal to said inductive coil comprises the step of transformer-coupling said signal into one of the leads to said inductive coil, whereby said signal is effectively added to any signal already being applied across said inductive coil.

8. Apparatus for use in connection with an existing inductive coil originally embedded in the roadway for a purpose unrelated to providing motor vehicles with location information, said coil being connected to a circuit which applies a first signal thereto in pursuance of said purpose, comprising:

means for generating a signal uniquely representative of the specific geographic location of an associated inductive coil, and means adapted to be coupled to said inductive coil for effectively applying said signal thereacross, said signal thereby adding to said first signal applied to said coil by said circuit, whereby said inductive coil then creates a magnetic field above said roadway including a component which is modulated in accordance with said location-representative signal, in addition to the field component produced in response to said first signal.

9. A method of communicating location information to a vehicle, comprising the steps of generating a signal representative of a location at which an inductive coil is embedded in a roadway as part of a traffic detection system;

applying said signal to the inductive coil embedded in the roadway at said location whereby a modulated magnetic field is established above said roadway at said location;

sensing magnetic fields at said vehicle whereby said magnetic field established at said location is sensed when said vehicle is at said location; and deriving said location information from said sensed magnetic field.

10. A system for keeping track, from a central station, of the specific geographic locations of the individual vehicles of a fleet of vehicles, comprising:

a plurality of location-identifying means, each associated with a pre-existing inductive coil originally embedded in the roadway for a purpose unrelated to fleet vehicle locating, each coil being connected to a pre-existing circuit which applies a first signal to said coil, each location-identifying means including first means for providing an electrical signal uniquely indicating the specific geographic location of the associated inductive coil, and second means for applying said signal to said coil without interfering with said first signal applied to said associated coil correlative to said purpose unrelated to fleet vehicle locating, and receiving means adapted to be mounted on each said fleet vehicle, said receiving means including magnetic field sensitive means adapted to be mounted on said fleet vehicle for sensing magnetic fields generated over said roadway by said inductive coils and for providing output signals corresponding to said location-identifying signals, and means for communicating said location-identifying signals from said vehicle to said central station.

* * * * *